US005368148A

United States Patent [19]

Orlandini

[11] Patent Number: 5,368,148

[45] Date of Patent: Nov. 29, 1994

[54] DEVICE FOR CONVEYING PRINTED SHEETS IN AN INSTALLATION FOR CHECKING THE QUALITY OF PAPER MONEY

[75] Inventor: Dante Orlandini, Milan, Italy

[73] Assignee: De La Rue Giori S.A., Lausanne, Switzerland

[21] Appl. No.: 20,427

[22] Filed: Feb. 22, 1993

[30] Foreign Application Priority Data

Mar. 3, 1992 [CH] Switzerland ..... 662/92

[51] Int. Cl.[5] ..... G07D 7/00; B65H 29/04

[52] U.S. Cl. ..... 194/207; 271/204; 271/277

[58] Field of Search ..... 194/206, 207; 271/204, 271/277

[56] References Cited

U.S. PATENT DOCUMENTS

| | | | |
|---|---|---|---|
| 2,657,052 | 10/1953 | Elliott . | |
| 4,225,129 | 9/1980 | Zimmerman et al. | 271/204 |
| 5,115,144 | 5/1992 | Konishi et al. | 271/204 X |
| 5,140,166 | 8/1992 | Gerlier | 271/227 X |

FOREIGN PATENT DOCUMENTS

| | | |
|---|---|---|
| 760051 | 8/1933 | France . |
| 2720674 | 11/1978 | Germany . |
| 2908362 | 6/1980 | Germany . |
| 3412181 | 1/1985 | Germany . |
| 9115032 | 1/1992 | Germany . |
| 491981 | 10/1938 | United Kingdom . |
| 2055087 | 2/1981 | United Kingdom . |

*Primary Examiner*—F. J. Bartuska

*Attorney, Agent, or Firm*—Kane, Dalsimer, Sullivan, Kurucz, Levy, Eisele & Richard

[57] ABSTRACT

The device comprises a conveyor chain (1) for the sheets to be checked (3) by a detector (5). The support bars (4, 4'), on which the sheet to be examined (3) slides, are fitted, in the checking zone, with suction nozzles (4a) and in the gap between two support bars (4) there are provided movable arms (10), fitted at their end with suction nozzles (10a) which, in the operating position, are aligned with the suction nozzles (4a) of the support bars and arranged in the sheet transfer plane in order to hold the sheet to be examined (3) in this plane. In order to prevent the clamps (2a) which pull the sheet (3) from touching the arms (10), a mechansim is provided for tilting the arms (10) when the clamps (2a) pass above these arms.

7 Claims, 3 Drawing Sheets

DEVICE FOR CONVEYING PRINTED SHEETS IN AN INSTALLATION FOR CHECKING THE QUALITY OF PAPER MONEY

FIELD OF THE INVENTION

The present invention relates to a device for conveying printed sheets in an installation for checking the quality of paper money, particularly bank notes, in a checking zone comprising at least one detector.

PRIOR ART

Devices are already known for checking the quality of bank notes. For example, Patent FR 1,489,113 describes a method and a device according to which non-cut sheets of notes are firstly checked visually in order to enable the operator to mark the faulty notes, exhibiting errors in color or stains. The sheets are then cut into notes which pass on a first cylinder in front of detectors checking the side of the note facing outward and reacting to the checking marks borne by the notes, as well as to the errors in the centering of the print. The notes are then transferred to a second cylinder where detectors check the other side. The faulty notes are automatically picked out of the conveyor chain and replaced by faultless notes. Finally, an automatic installation makes it possible to count the checked notes and to pack them in the form of wads.

With the latest developed techniques, the requirements for checking the quality of recently printed notes are increasing more and more. The detectors which pick up the details of register, of color, of ink variation, of faults such as stains, spoils, etc. are becoming increasingly sophisticated which results in very strict requirements regarding the position of the sheets to be examined with respect to said detectors, the sheets having to be kept at a very precise distance from the detector. In a parallel patent application, the applicant has already proposed a conveying cylinder fulfilling these requirements.

A complete quality check must also comprise a check of transparency or check by reflection in order to examine, in particular, the position of the water mark, of the safeguarding thread, and all the other criteria which can be verified by transparency or reflection. In order to carry out these checks, the sheets must be in the plane state, and therefore must be brought on a conveyor chain fitted with clamps which grasp the front edge of the sheet in order to make it pass in front of the system for detection by transparency, or reflection, while said sheet slides in the transfer plane.

It became clear that the sheets grasped by the clamps, with a relatively high speed of conveyance, of the order of 2.8 meters per second, tend not to adhere securely to the support. Indeed, the sheets to be examined which have also been printed in intaglio, exhibit very sizeable deformations due to the striking force during the printing and their surface exhibits undulations which, added to the aerodynamic effects created by the speed of conveyance of the sheets, produce conditions which are unacceptable for an accurate scanning, considering the precision of current detectors. For the transparency check, it is therefore essential that this sheet, at least while it passes under the detector, remains in its perfectly plane state, without forming undulations, because the distance between the detector and the checking zone in which the sheet is located must remain constant with a predetermined tolerance, for example of approximately ±0.3 mm.

SUMMARY OF THE INVENTION

The present invention proposes to build a conveyor chain device which guarantees that the sheet assumes a perfectly plane state while it passes in front of the detector system, without any risk of damaging the print recently produced on the sheets.

The advantage of this device is to enable the printed sheet to be securely held by the vacuum system in the transfer plane defined by the support bars, when it passes below the detector, while avoiding a collision between the suction nozzles and the clamps when the latter draw level with the nozzles.

BRIEF DESCRIPTION OF THE DRAWINGS

The invention will be described, by way of non-limiting example, with reference to the attached drawings.

DESCRIPTION OF THE PREFERRED EMBODIMENT

Figure 1:
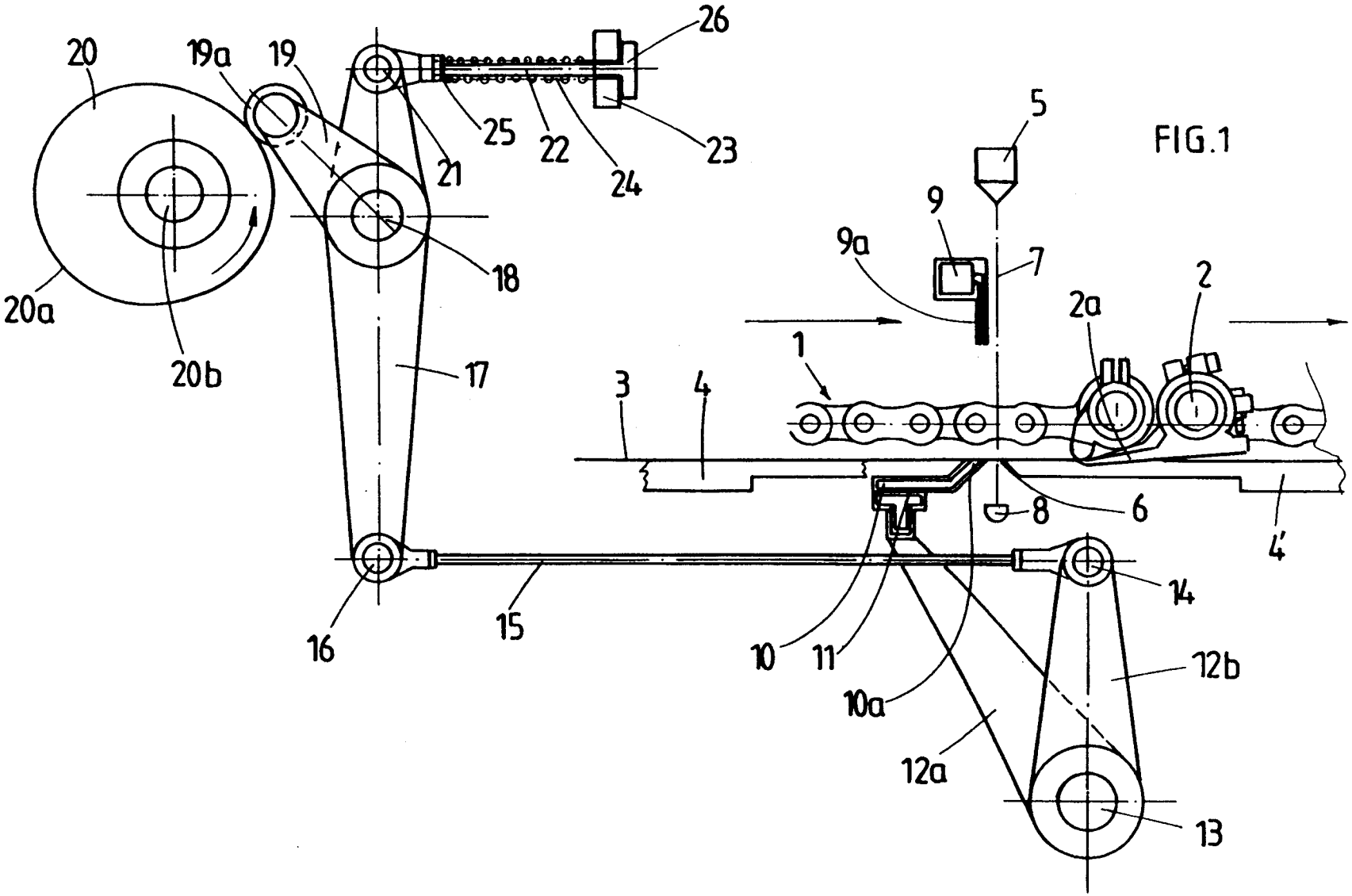
FIG. 1 depicts a diagrammatical view of the device, adapted for the example of a transparency check.
Figure 2:
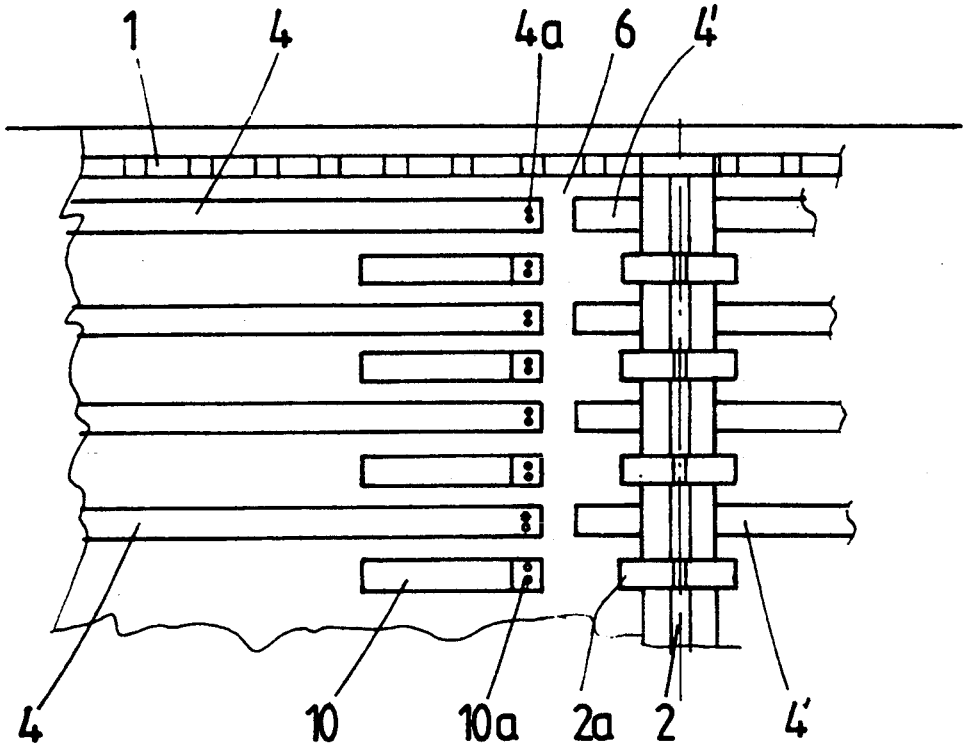
FIG. 2 is a partial view from above of the support bars and of the movable arms in the checking zone.

In the depicted installation for detection, the conveyor chain 1 is fitted with bars 2 with clamps 2*a* for gripping the front edge of each of the sheets to be examined 3 and sliding them over a support formed by support bars 4, 4', between a detector 5 and a lamp 8. The support bars 4, 4' extend longitudinally in the direction of conveyance and are separated by a distance of approximately 15 to 20 mm. The clamps 2*a* which grip the sheets and which are, for example, twelve in number, move partially into the gaps between the support bars. All the sheets, only one of which is depicted in the figure, follow on one behind the other at set and constant intervals.

The detector 5 is used for checking transparency, that is to say for checking the existence of details and of characteristics which appear only by transparency. For this purpose, the support bars 4, 4' are provided with a slit 6 located in the zone for checking the sheet, the bars located in front of the sheet 6 are denoted by the reference 4 while those located after the slit are denoted by the reference 4'. The lamp 8, placed below this slit 6 and the plane of the support bars 4, 4' in the reading direction 7 of the detector 5, makes it possible to illuminate the zone to be examined through the slit 6. This checking zone is in the shape of a line transverse to the direction of conveyance of the sheets.

In order to prevent the sheet to be examined 3 from coming off the support bars 4, an air blower is provided by means of a bar 9, with nozzles 9*a* directed toward the sheet 3 in the region of the slit 6.

In order to hold the sheet to be examined 3 securely in the checking zone in a plane state, at a constant distance from the detector 5 and with a tolerance of ±0.3 mm, the support bars 4 are provided at their end limiting the front of the slit 6, with suction nozzles 4*a* aligned in a transverse line located in the checking zone. In addition, in the space existing between the support bars 4, there are mounted movable arms 10 fitted with nozzles 10*a* at their end. In the operating position, the nozzles 10*a* and 4*a* form a single suction line arranged transversely to the direction of conveyance of the sheets, this suction line being located in the sheet transfer plane. The auxiliary suction nozzles 10*a* are in fact necessary for guaranteeing that the sheets are in a perfectly plane state in the checking zone and preventing any risk of deformation in the spaces between the support bars 4. By thus inserting movable arms 10 between the support bars 4, the clear distance between the bars and said adjacent arms is reduced to only 0.5 to 1 mm.

The nozzles 4*a* of the support bars 4 are linked to a vacuum system (not shown) and the nozzles 10*a* are linked to a vacuum conduit 11 which is itself also linked to this vacuum system; the vacuum force is adjusted so that the suction enables the sheet to be held securely without deformation. The connection between the nozzles 4*a* and the vacuum is not shown on the drawing.

Figure 3:
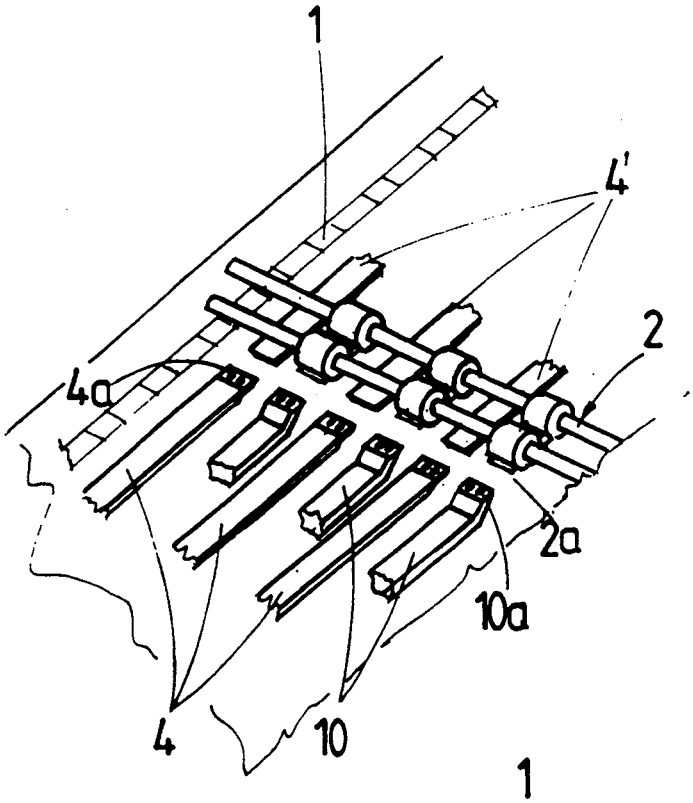
FIG. 3 is a partial view, in perspective, of the checking zone according to FIG. 2, with the arms in the operating position.
Figure 4:
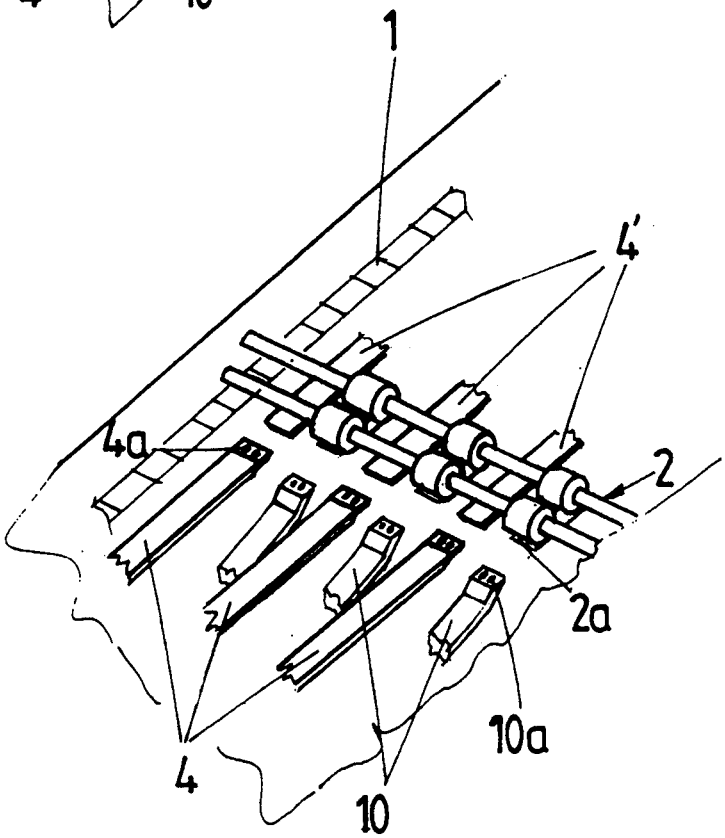
FIG. 4 depicts the same view as FIG. 3, but with the arms in a position which is retracted with respect to the transfer plane.

In order to prevent a clamp 2*a* from touching the end of the arms 10 fitted with the nozzles 10*a*, a mechanism for actuating these arms is provided. The assembly formed by the arms 10 and the vacuum conduit 11 is mounted in a movable manner with respect to the support bars 4 and, for this purpose, is fixed to the end of a lever with two arms 12*a*, 12*b*. This lever 12*a*, 12*b* is articulated on a stationary spindle 13 and the end of the second am 12*b* is linked by an articulation 14 on a transmission bar 15 the other end of which is itself linked by an articulation 16 to the end of a control lever 17. The control lever 17 is mounted on a fixed pivot 18 and is firmly attached to a lever arm 19 which is itself also articulated on the pivot 18. A follower roller 19*a*, which interacts with a cam 20, with its lobe 20*a*, is mounted at the free end of the lever arm 19. This cam 20 is mounted on a shaft 20*b*, the rotation of which is synchronized with the speed of forward motion of the chain 1 in such a way that the cam 20 completes one revolution while the chain 1 moves forward by the length of a gap between two bars 2 with clamps, therefore between two successive sheets. The other end of the control lever 17 is articulated at 21 to a threaded rod 22 fitted at its end with a stop-piece 26 which bears against a fixed stop-piece 23. A return spring 24 acting in compression and mounted between the fixed stop-piece 23 and a collar 25 enables the follower roller 19*a* to be pressed against the surface of the cam 20. The operating position depicted in FIGS. 1 and 3 is defined by the contact of said stop-pieces 23, 26, and may be adjusted by changing the position of the stop-piece 26 on the threaded rod 22 on which it is screwed.

The shape of the cam 20 and the synchronization of the movements of rotation of the shaft 20*b* and of the forward motion of the chain 1 are such that the arms 20 remain in their operating position, that is with the nozzles 10*a* aligned and in the same plane as the nozzles 4*a* of the support bars 4 during the whole time that the sheet 3 passes above the slit 6, and therefore in the checking zone where it is securely held in the transfer plane by the action of the suction nozzles 4*a*, 10*a*. When the clamps 2*a* draw level with the slit 6, the cam 20, with its lobe 20*a*, tilts the lever 17, against the action of the spring 24, which causes the transmission arm 15 to move, which in turn causes the bent lever 12*a*, 12*b* to tilt about the pivot 13, and consequently the ends of the arms 10 with their nozzles 10*a* to move downward. This movement may be, for example, of a few millimeters. The clamps 2*a* are thus prevented from touching the arms 10 while they pass across the slit 6.

As soon as the bar 2 with clamps 2*a* has travelled past the region of the checking zone, the roller 19*a* has travelled past the lobe 20*a* of the cam 20 and the levers 17, 19, under the action of the spring 24, move the arms 10 back into the operating position via the transmission arm 15 and the levers 12*a*, 12*b*, this operating position being defined by the stop-piece 26 bearing against the fixed stop-piece 23. Furthermore, in this operating position, it is not necessary for the roller 19*a* to touch the cam 20 in its part which does not include the lobe 20*a*.

The invention is not limited to the embodiments described and embodiment variants could be added without thereby leaving the scope of the invention.

I claim:

1. A device for conveying printed sheets in an installation for checking the quality of paper money, particularly bank notes, in a checking zone comprising at least one detector (5), wherein said device is a conveyor chain (1) equipped with bars with clamps (2, 2*a*) for grasping the front edge of the sheet to be checked and sliding it over support bars (4, 4'), extending longitudinally in the direction of conveyance, in a transfer plane, the clamps (2*a*) being partially engaged in the spaces between said support bars (4, 4'), wherein, in the checking zone, the support bars (4, 4') are fitted with holes forming suction nozzles (4*a*) along a line transverse to the direction of conveyance and wherein, in the spaces between the support bars (4), there are mounted movable arms (10) fitted with a suction nozzle (10*a*), these arms being linked to an actuating mechanism for moving them between an adjusted operating position, in which the nozzles (10*a*) of the arms (10) are aligned with the nozzles (4*a*) of the support bars (4) in order to hold the sheet to be checked in the transfer plane when passing through said zone, and a withdrawn position below said plane when the clamps (2*a*) pass above the location of the arms (10) in order to avoid a collision between said clamps (2*a*) and said arms (10).

2. The device as claimed in claim 1, wherein, in order to check the transparency of the sheets, the support bars (4, 4') are discontinued in the checking zone by a slit (6) transverse to the direction of conveyance of the sheets, wherein a light source (8) is installed on the opposite side of the slit (6) to the detector (5), said movable arms (10) being located in front of said slit (6) and wherein the nozzles (4*a*) of the support bars (4) and the nozzles (10*a*) of the arms (10) are located at the ends of said bars (4) and of the arms (10) limiting the front edge of the slit (6).

3. The device as claimed in claim 1, wherein an air blower is provided by means of air nozzles (9*a*) installed above the transfer plane and directed toward the checking zone and the top of the sheet (3).

4. A device for conveying printed sheets in an installation for checking the quality of paper money, particularly bank notes, in a checking zone comprising at least one detector (5), wherein said device is a conveyor chain (1) equipped with bars with clamps (2, 2*a*) for grasping the front edge of the sheet to be checked and sliding it over support bars (4, 4'), extending longitudinally in the direction of conveyance, in a transfer plane, the clamps (2*a*) being partially engaged in the spaces between said support bars (4, 4'), wherein, in the checking zone, the support bars (4, 4') are fitted with holes forming suction nozzles (4*a*) along a line transverse to the direction of conveyance and wherein, in the spaces between the support bars (4), there are mounted movable arms (10) fitted with a suction nozzle (10*a*), these arms being linked to an actuating mechanism for moving them between an adjusted operating position, in which the nozzles (10*a*) of the arms (10) are aligned with the nozzles (4*a*) of the support bars (4) in order to hold the sheet to be checked in the transfer plane when passing through said zone, and a withdrawn position below said plane when the clamps (2*a*) pass above the location of the arms (10) in order to void a collision between said clamps (2*a*) and said arms (10), in order to check the transparency of the sheets, the support bars (4, 4') are discontinued in the checking zone by a slit (6) transverse to the direction of conveyance of the sheets, wherein a light source (8) is installed on the opposite side of the slit (6) to the detector (5), said movable arms (10) being located in front of said slit (6) and wherein the nozzles (4*a*) of the support bars (4) and the nozzles (10*a*) of the arms (10) are located at the ends of said bars (4) and of the arms (10) limiting the front edge of the slit (6), means are provided for adjusting the arms (10) in said slit (6), in their operating position.

5. The device as claimed in claim 4, wherein the means for adjusting the arms (10) in their operating position consist of a stop-piece (26) mounted by screwing on to a threaded rod (22) and bearing in this operating position against a fixed stop-piece (23) under the action of said spring (24).

6. A device for conveying printed sheets in an installation for checking the quality of paper money, particularly bank notes, in a checking zone comprising at least one detector (5), wherein said device is a conveyor chain (1) equipped with bars with clamps (2, 2*a*) for grasping the front edge of the sheet to be checked and sliding it over support bars (4, 4'), extending longitudinally in the direction of conveyance, in a transfer plane, the clamps (2*a*) being partially engaged in the spaces between said support bars (4, 4'), wherein, in the checking zone, the support bars (4, 4') are fitted with holes forming suction nozzles (4*a*) along a line transverse to the direction of conveyance and wherein, in the spaces between the support bars (4), there are mounted movable arms (10) fitted with a suction nozzle (10*a*), these arms being linked to an actuating mechanism for moving them between an adjusted operating position, in which the nozzles (10*a*) of the arms (10) are aligned with the nozzles (4*a*) of the support bars (4) in order to hold the sheet to be checked in the transfer plane when passing through said zone, and a withdrawn position below said plane when the clamps (2*a*) pass above the location of the arms (10) in order to void a collision between said clamps (2*a*) and said arms (10), said actuating mechanism comprises a cam (2) rotating at a speed which is synchronized with the speed of conveyance of the sheets, and at least one lever which tilts the arms (10) between said position.

7. The device as claimed in claim 6, wherein the arms (10) are mounted at the end of a bent lever (12*a*, 12*b*), articulated on a stationary spindle (13) and actuated via a transmission bar (15) which is articulated to a control lever (17, 19) fitted with a roller (19*a*) interacting with said cam (20) under the action of a spring (24), the configuration of the cam (20) being such that the nozzles (10*a*) of the arms (10) are in the operating position in the transfer plane, while the sheet to be checked moves in the checking zone and that the arms (10) are tilted downward as the clamps (2*a*) pass.

* * * * *